US005968433A

United States Patent [19]

Belch et al.

[11] Patent Number: 5,968,433

[45] Date of Patent: Oct. 19, 1999

[54] PROCESS FOR SPINNING OF SOLUTIONS OF CELLULOSE CARBAMATE

[75] Inventors: Marco Belch, Mainz-Kostheim; Gerhard Keunecke, Pulheim; Juergen Wack, Muehlheim am Main, all of Germany

[73] Assignee: Zimmer Aktiengesellschaft, Frankfurt, Germany

[21] Appl. No.: 09/048,654

[22] Filed: Mar. 26, 1998

[30] Foreign Application Priority Data

May 23, 1997 [DE] Germany ..... 197 21 609

[51] Int. Cl.[6] ..... D01F 2/28

[52] U.S. Cl. ..... 264/187

[58] Field of Search ..... 264/187

[56] References Cited

U.S. PATENT DOCUMENTS 710,819 10/1902 Thiele ..... 264/187 X

FOREIGN PATENT DOCUMENTS 103618 2/1986 European Pat. Off. .
97685 6/1986 European Pat. Off. .
3904541 8/1990 Germany .
4219658 12/1993 Germany .
19515136 10/1996 Germany .
2164941 4/1986 United Kingdom .
2164942 4/1986 United Kingdom .
2164943 4/1986 United Kingdom .

OTHER PUBLICATIONS

Turunen et al., *Lenzinger Berichte*, "Some Aspects on the Spinning of the Cellulose Carbamate", pp. 111–115, Aug. 1985.

*Chemiefasern*, Chemie–Technologie, Georg Thieme Verlag Stuttgart, New York, p. 134, 1982.

Schmiedeknecht, *Lit. S. 607*, 23. Das Trichterspinnverfahren, pp. 602–607 (Undated).

*Primary Examiner*—Leo B. Tentoni
*Attorney, Agent, or Firm*—McDonnell Boehnen Hulbert & Berghoff

[57] ABSTRACT

The invention is a process for spinning solutions of cellulose carbamate by extruding the solution through a spinneret into a precipitation bath, coagulating the cellulose carbamate fibers thus formed and drawing off the fibers by mechanical means, where the fibers are enveloped from the outlet from the spinneret to the outlet from the precipitation bath in a stream of precipitating medium flowing in the same direction, where the velocity of flow of the precipitation medium where the fibers exit the spinneret (plane X1) amounts to 0.1 to 0.8 times the draw-off speed of the fibers, and the velocity of flow of the precipitation medium where the fibers exit the precipitation bath (plane X3) amounts to 0.96 to 1.1 times the draw-off speed of the fibers.

5 Claims, 2 Drawing Sheets

PROCESS FOR SPINNING OF SOLUTIONS OF CELLULOSE CARBAMATE

BACKGROUND

1. Field of the Invention

The invention relates to a process and a device for spinning cellulose carbamate solutions by extruding the solution through a spinneret into a precipitation bath, coagulating the cellulose carbamate fibers thus formed by bringing them in contact with the precipitation medium, and drawing off the fibers by mechanical means after discharge from the precipitation bath.

2. Summary of the Related Art

It is known that aqueous alkaline solutions of cellulose carbamate can be spun in acidic, alkaline, or alcoholic precipitation baths in accordance with the techniques used with viscose fibers (European Patents Nos. 97,685 and 103,618; British Patents Nos. 2,164,941, 2,164,942 and 2,164,943; O. T. Turunen, Leonine Berichte [August 1985] no. 59, pages 111–115). However, these publications are concerned with the composition of the precipitation baths and do not give details on the spinning apparatus.

Various techniques are known for spinning viscose fibers, including tube spinning where the fibers are guided through a horizontal cylindrical tube within the precipitation bath after leaving the spinneret (Z. A. Rogowin, Cheiniefasern [Manmade Fibers], Thieme-Verlag [1982], page 134), and funnel spinning, where the fibers, after leaving the spinneret, arc sent together with the precipitation medium through a vertical funnel that is conical over the entire length (K. G ötze, Chemiefasern nach dem Viskoseverfahren [Manmade Fibers by the Viscose Method], Springer-Verlag, $3_{rd}$ edition, volume 2, pages 602–607). Similarly designed spinning funnels have also been described for dry-wet spinning of cellulose solutions in aqueous N-methylmorpholine N-oxide (NMMO) (German Patents Nos 4,219,658 C and 19,515,136 A).

An important disadvantage of the tube spinning method is the lack of exchange of the precipitation medium between the inside and outside of the tube and the resulting accumulation within the tube of solvent and possible cleavage products from the spinning solution. The German Patent No. 39 04 541 A1 therefore proposes to circulate the precipitation medium through a spinning tube, preferably from bottom to top for a vertical tube, wherein the velocity of flow of the precipitation medium at the exit of the spinning tube is set to a value lower than the draw-off speed of the fibers, and corresponding to a velocity to speed ratio of 0.15 to 0.95. This helps the exchange of the precipitation medium within the tube, but causes on the fibers a force opposed to the draw-off direction, which influences the morphology of the fiber.

In the spinning funnel method, however, the flow velocity of the precipitation medium within the funnel is so high as to cause the fibers to stretch due to the fiber/fluid friction. In both cases, the freshly extruded fibers are exposed to turbulence occurring mainly at the nozzle surface immediately after leaving the spinneret and before entering the spinning tube or the spinning funnel, which in turn has a negative effect on fiber uniformity.

Whereas simultaneous coagulation and saponification of the cellulose xanthogenate to regenerated cellulose fibers with a much greater strength and coherence occurs on entering the precipitation bath, cellulose carbamate undergoes only coagulation. The freshly spun cellulose carbamate fibers are consequently much more susceptible to turbulence or other disturbances and stretching forces within the precipitation bath than are regenerated cellulose fibers. Therefore, direct transfer of the spinning techniques used with viscose or cellulose-NMMO solutions to spinning solutions of cellulose carbamate is either impossible or leads to poor quality fibers.

In view of the foregoing, therefore, improved techniques applicable to spinning solutions of cellulose carbamate are desired.

SUMMARY OF THE INVENTION

The object of the present invention is to create a method and a device for spinning cellulose carbamate solutions that will yield fibers of a high uniformity and good quality. Furthermore, adaptation to different spinning rates is easily implemented.

The present invention achieves this object by providing a new method and device for spinning cellulose carbamate. The method is characterized in that, from its exit from the spinneret to its exit from the precipitation bath, the fibers are enveloped by a stream of the precipitation medium (with a predetermined cross section) flowing in the same direction as the spinning cellulose carbamate fibers, where the velocity of flow of the precipitation medium where the fibers exit the spinneret (plane X1 in FIGS. 1 and 2) amounts to 0.1 to 0.8 times the draw-off speed of the fibers, and the velocity of flow of the precipitation medium where the fibers exit the precipitation bath (plane X3 in FIGS. 1 and 2) amounts to 0.96 to 1.1 times the draw-off speed of the fibers. The device for carrying out the process comprises a precipitation bath tank (15) with an inlet line (12) for the precipitation medium and, inside the tank, a truncated conical spinneret (3) and a truncated conical spinning funnel (5) with an attached cylindrical tube (6) projecting through the wall of the precipitation bath tank, and, outside the tank, a mechanical fiber draw-off device (9), where the spinneret (3) is situated at least partially within the spinning funnel (5) to form a concentric gap between the spinneret and funnel. The spinneret (3) is preferably a truncated cone shaped and has the same cone angle (a) as the spinning funnel (5), tapering in the direction of flow of the solution to be spun.

The invention also comprises a device, as described above, for carrying out the foregoing method.

The foregoing merely summarizes certain aspects of the invention and is not intended, nor should it be construed, as limiting the invention in any manner. The invention is explained in greater detail below with reference to the schematic diagrams (not to scale) given as examples.

DETAILED DESCRIPTION OF THE PREFERRED EMBODIMENTS

Figure 1:
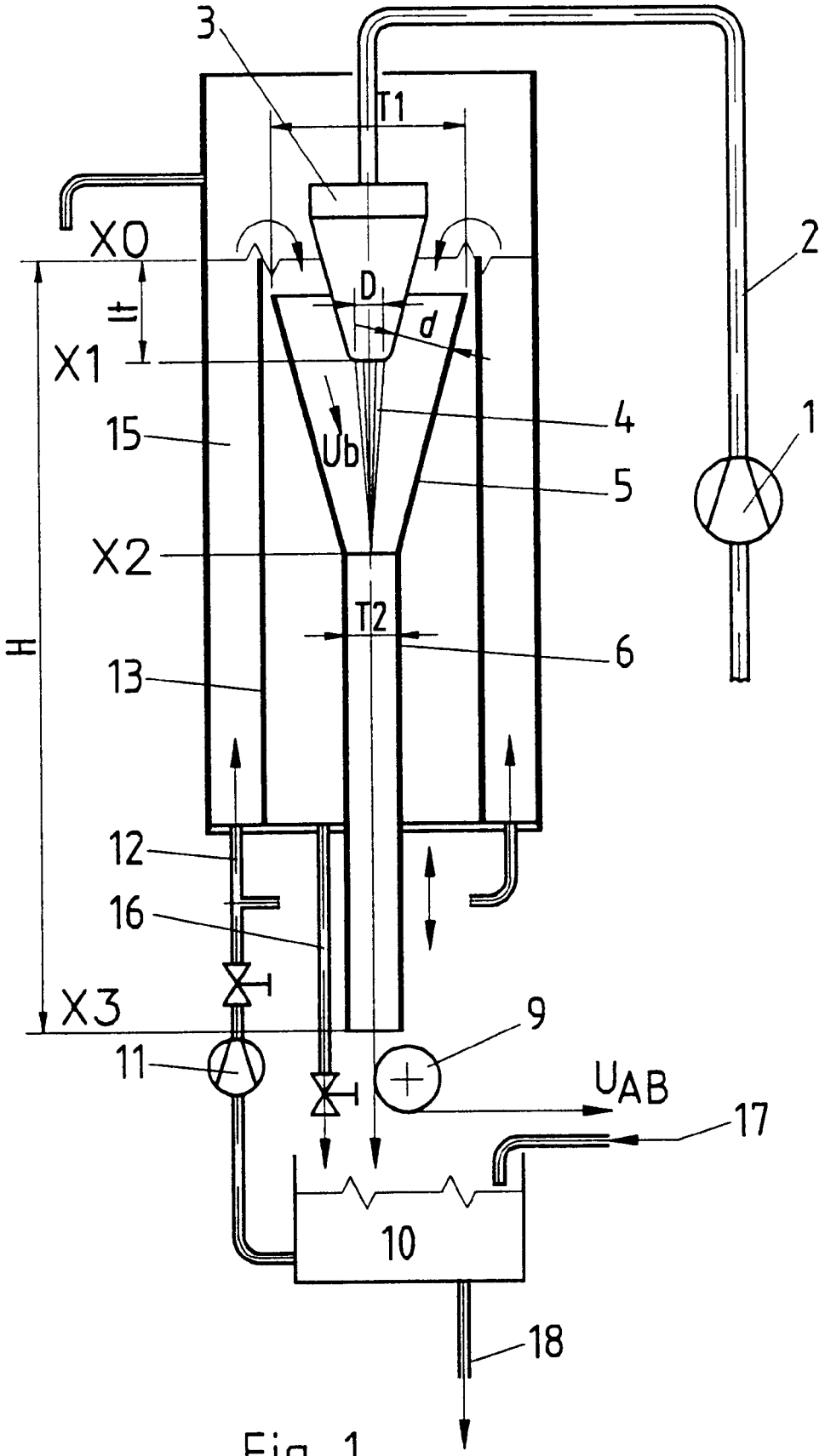
FIG. 1 displays a device according to this invention oriented vertically. Plane s X1–X3 are orthogonal to the direct ion of flow.

When spinning cellulose carbamate, the filaments are very unstable immediately upon entering the precipitation bath. At extremely low fiber draw-off speeds, coagulation of the fibers can occur in a stationary precipitation bath. With an increase in fiber draw-off speeds and thus an increase in friction between the fiber and the precipitation bath, increased turbulence occurs at the nozzle surface and along the filaments, negatively effecting fiber quality. To suppress this turbulence and reduce the fiber/liquid friction, the present invention imposes a directed flow ($U_B$) on the filament strands (4) from the outside. It is important to avoid the impressed stream separating at the lower edge of the spinneret (3) in plane X1 and forming turbulent flow. This is achieved by spinning the filaments (4) in the cone (5) of a spinning funnel through the nozzle holes of a spinneret (3) designed as a truncated conical flow body with the nozzle holes disposed on its smaller front side (plane X1). The oncoming flow of precipitation medium is directed against the fibers (4) directly upon exit of the fibers from the spinneret (3) and as nearly parallel to the direction of flow of the fiber s as possible, thereby entraining the filaments. Thus, the direction of flow of the precipitation medium is in the same general direction as the direction of flow of the cellulose carbamate fibers, i.e., the precipitation medium's largest flow velocity component is in the same direction as that of the cellulose carbamate fibers. To accomplish this, the spinneret (3) is situated at least partly within the spinning funnel (5), forming a concentric gap with gap width (d) between the spinneret (3) and the funnel cone (5). The spinneret (3) and the funnel cone (5) preferably have the same cone angle (a) and taper in the direction of flow of fibers and the precipitation bath medium. The velocity of flow ($U_B$) of the precipitation medium is 0.1 to 0.8 times the draw-off rate ($U_{AB}$) of the fibers at the outlet of the fibers from the spinneret (plane X1) and 0.96 to 1.1 times at the outlet of the fibers from the precipitation bath (plane X3). The velocity of flow of the precipitation medium at the outlet of the fibers from the precipitation bath (plane X3) is in any case based on the cross-sectional area of the cylindrical spinning tube with the diameter T2. Optionally, a conical end section and/or a diaphragm with variable aperture is attached to the spinning tube downstream at plane X3. Due to the reduced cross-section of such an end piece the velocity of flow through it is higher than through plane X3.

The velocity of flow ($U_B$) of the precipitation medium through the plane (X3) is adjustable via the hydrostatic height (H) of the precipitation bath, according to $U_B = E \cdot \sqrt{2g \cdot H}$, where E is the coefficient of friction of the liquid (about 0.97) and g is the acceleration due to gravity. Alternatively, the velocity of flow of the precipitation medium through plane X3 can be adjusted, in the case of a closed, full precipitation bath tank, by variation of the precipitation medium pump (11) feed pressure. In accordance with the constant diameter T2 of the cylindrical spinning tube (6), the velocity of flow of the precipitation medium through the whole tube from plane X2 to plane X3 is approximately equal to the fiber draw-off rate ($U_{AB}$). The velocity of flow through the plane (X1) is lower at this point than that through the plane (X3) in accordance with the larger cross section of the spinning funnel (5). An adjustment is possible by varying the depth of insertion (lt) of the spinneret (3) into the spinning funnel (5) and thus the cross section of the precipitation medium flow through the plane (X1).

FIG. 1 shows a vertical spinning arrangement with spinning direction from top to bottom that is especially suitable for high fiber draw-off rates. The cellulose carbamate spinning solution, consisting preferably of 5 to 12 wt % cellulose carbamate in 5% to 10% wt. aqueous sodium hydroxide solution is sent at a temperature of approximately 0° C. to +30° C. by the spinning pump (1) through the line (2) to the spinneret (3). The fibers (4) discharged from the spinneret (3) at the plane X1 are exposed to the precipitation medium, which flows through the spinning funnel (5) from top to bottom at rate ($U_B$) in a direction that is at a small angle diagonal to the path o f the fibers and which thus entrains the fibers. The spinning funnel consists of an upper truncated conical part (5), followed through the plane (X2) by a cylindrical tubular part (6), which, as shown in FIG. 1, ends at plane X3. Optionally the tube (6) can end by a conical end piece and/or a diaphragm attache d to the tube (6) immediately below plane X3. The fibers (4) are drawn off by a mechanical draw-off mechanism (9), e.g., a pair of driven rolls, at a rate ($U_{AB}$), while the accompanying stream of precipitation medium flows into the storage tank (10). Th e cellulose carbamate fibers are the n washed, drawn, and saponified to regenerated cellulose fibers at a high temperature.

The precipitation medium goes from the storage tank (10) by means of the pump (11) through line (12) into the precipitation bath tank (15), which is equipped with an inside wall (13) that is designed as an overflow and is preferably arranged concentrically with the wall of the tank for the purpose of achieving a uniform turbulence-free flow of precipitation medium. The precipitation medium flows over the wall (13) into the spinning funnel (5). Both aqueous solutions of acids as well as of alkalis and/or salts can be used as the precipitation medium. Alcohols arc also suitable. An aqueous solution with 5 to 25 wt % $H_2SO_4$ and 5 to 25 wt % $Na_2SO_4$ at a temperature of approximately 20° C. to 60° C. is preferred. By reaction with the alkaline spinning solution, the precipitation medium becomes enriched with the resulting salts (e.g., sodium sulfate) while flowing through the spinning funnel (5 and 6). Up to a certain concentration, which depends on the composition of the precipitation medium, these salts can remain in the precipitation medium. Since the lower end of the spinning funnel (6) is outside the precipitation bath tank (15), the composition of the precipitation medium flowing out of the tube (6) can easily be corrected before it is pumped through line (12) back into the tank (15), e.g., by partial discharge through line (18) and fresh supply through line (17).

The fiber draw-off speed ($U_{AB}$) depends on the equipment used and especially the titer of the fibers to be spun. In general, draw-off speeds of 30 to 500 m/min (preferably 50 to 350 m/min) are very suitable. The corresponding velocity of flow of the precipitation medium through the plane (X3), which is preferably approximately the same as the draw-off speed, is adjusted by vertical adjustment of the spinning funnel (5 and 6) position with respect to the position of the precipitation bath tank (15), which varys the hydrostatic height (H) of the precipitation medium. The oncoming velocity of flow of the precipitation medium through the plane (X1) is adjusted at the same time by varying the depth of insertion (lt) of the spinneret (3) in the spinning funnel (5), which determines the cross-sectional area through which the precipitation medium can flow. An additional adjustment may optionally be made by vertical adjustment of the precipitation bath tank (15) position with no change in hydrostatic height (H) and/or by vertical adjustment of the spinneret (3) position. A vertical adjustment of the precipitation bath tank (15) position with respect to the position of the spinning funnel (5 and 6) and/or a variation of the length of the spinning tube (6) are also possible.

Figure 2:
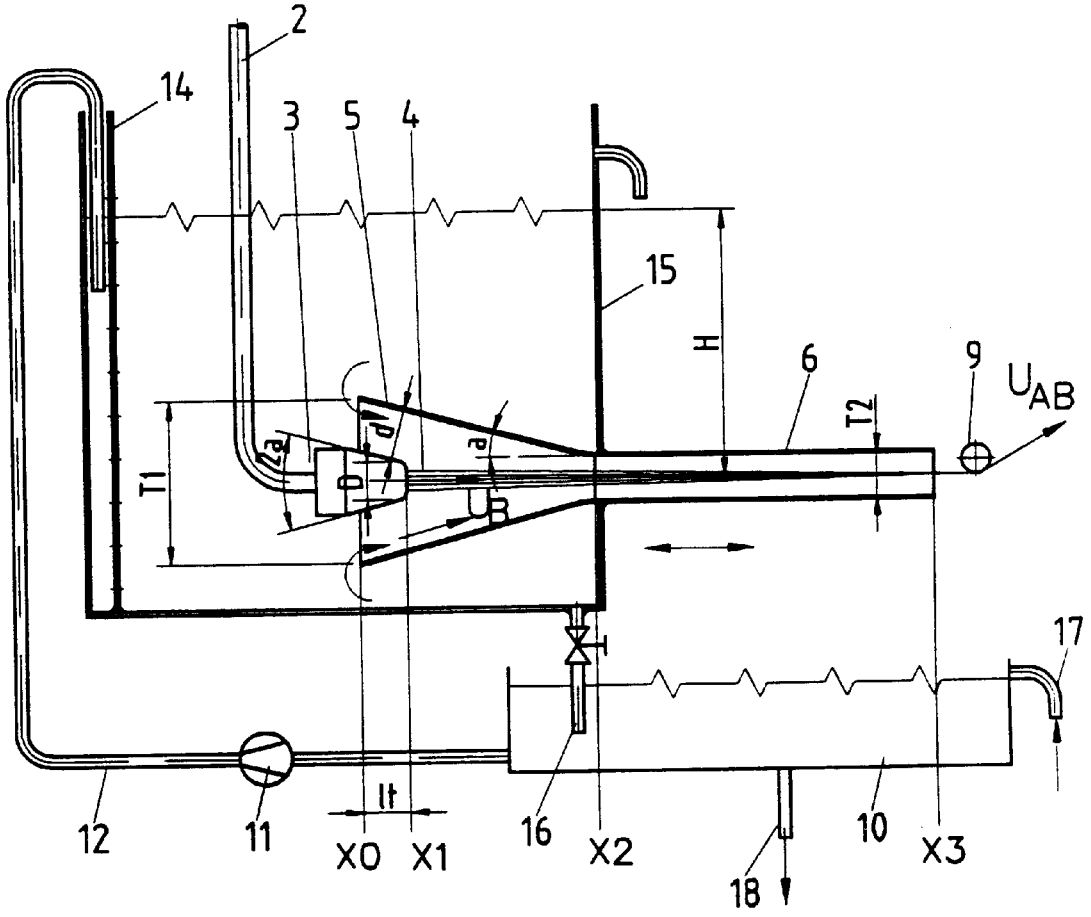
FIG. 2 displays a device according to this invention oriented horizontally. Planes X1–X3 are orthogonal to the direction of flow.

FIG. 2 shows a diagram of another embodiment of the device according to the invention, preferably used for low fiber draw-off speeds ($U_{AB}$). The individual elements of the device correspond to those in FIG. 1, but the spinneret and spinning funnel are arranged horizontally, as shown in FIG. 2.

The cellulose carbamate spinning solution is supplied to the spinneret (3) through line (2), and the spun fibers are drawn off by the draw-off device (9) through the spinning funnel (5 and 6). Spinneret (3) and the truncated conical part (5) of the spinning funnel are arranged in the precipitation medium inside the precipitation bath tank (15), while the tubular part (6) of the spinning funnel passes through the wall of the tank to the outside. The precipitation medium is sent from the supply tank (10) by means of the pump (11) through the line (12) to the precipitation bath tank (15). To prevent turbulence inside the precipitation bath tank (15) the inlet line (12) and the spinneret area are separated from each other by a permeable wall (14). The liquid level and the hydrostatic height (H) in the precipitation bath tank (15) are adjusted over a drain line (16) attached to the tank bottom and/or various overflow lines. The precipitation medium flows through the spinning funnel (5) in the spinning direction because of the hydrostatic pressure and it comes out again at the end of the spinning tube (6) through the plane (X3), from which it enters the storage tank (10), optionally after adjusting the concentration. To adjust the velocity of flow ($U_B$) of the precipitation medium through the plane (X1) and the depth of insertion (lt) of the spinneret (3) in the spinning funnel (5), the entire spinning funnel (5 and 6) is arranged so its position can be adjusted horizontally with respect to the position of the precipitation bath tank (15). As an alternative, or in addition, the spinneret (3) position could also be adjusted horizontally.

The dimensions of the device according to this invention depend on the intended throughput. In industrial facilities, for example, the spinneret diameter (D) is 10 to 300 mm, the spinning funnel diameter (T1) is 20 to 500 mm, the spinning tube diameter (T2) is 3 to 150 mm, the cone angle (a) is 5° to 30°, the total length of the spinning funnel including the spinning tube (5 and 6) is 300 to 4000 mm, preferably 300 to 2000 mm, and the hydrostatic height (H) is 10 to about 4000 mm, preferably to about 2000 mm. Suitable construction materials include glass and corrosion-resistant plastics and metals.

Spinneret (3) and spinning funnel (5 and 6) can be arranged not only vertically or horizontally, as described above, but also at any angle therebetween.

The cellulose carbamate to be spun can be produced by any desired method, e.g., by one of the methods according to U.S. Pat. No. 5,378,827, German Patent Applications Nos. 4,417,140, 19,635,473 and 19,715,617.

We claim:

1. In a process for spinning cellulose carbamate solutions by extruding the solution into a precipitation bath through a spinneret to form fibers, coagulating the cellulose carbamate fibers thus formed by bringing them in contact with the precipitation medium and drawing off the fibers at a predetermined rate by mechanical means after the fibers exit the precipitation bath, the improvement comprising, upon exiting from the spinneret, enveloping the fibers in a stream of precipitation medium having a predetermined cross section and flowing in the same general direction as the fibers, wherein the velocity of flow of the precipitation medium where the fibers exit the spinneret is adjusted to be 0.1 to 0.8 times the draw-off rate of the fibers, and the velocity of flow of the precipitation medium where the fibers exit the precipitation bath is adjusted to be 0.96 to 1.1 times the draw-off rate.

2. The process according to claim 1, wherein the cross section of the stream of precipitation medium decreases in a region just downstream of the fibers' exit from the spinneret, and then remains constant until the fibers exit the precipitation bath.

3. The process according to claim 1, wherein the flow velocity of the precipitation medium where the fibers exit the precipitation bath is adjusted by adjusting the hydrostatic height of the precipitation bath.

4. The process according to claim 1, wherein the flow velocity of the precipitation medium where the fibers exit the precipitation bath is adjusted by adjusting the feed pressure of the precipitation medium.

5. The process according to claim 1, wherein the velocity of flow of the precipitation medium where the fibers exit the spinneret is adjusted by varying the cross section of flow of the precipitation medium at that point.

* * * * *